US010036290B2

(12) United States Patent
Dwivedi et al.

(10) Patent No.: US 10,036,290 B2
(45) Date of Patent: Jul. 31, 2018

(54) CRANKCASE VENTILATION VALVE FOR AN ENGINE

(71) Applicant: Ford Global Technologies, LLC, Dearborn, MI (US)

(72) Inventors: Rishi Dwivedi, Westland, MI (US); Katherine Jane Brewer, Belleville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 261 days.

(21) Appl. No.: 15/203,097

(22) Filed: Jul. 6, 2016

(65) Prior Publication Data

US 2018/0010497 A1 Jan. 11, 2018

(51) Int. Cl.

| | |
|---|---|
| ***F01M 13/00*** | (2006.01) |
| ***F01M 13/04*** | (2006.01) |
| ***F01M 13/02*** | (2006.01) |

(52) U.S. Cl.

CPC .... *F01M 13/0405* (2013.01); *F01M 13/0011* (2013.01); *F01M 13/022* (2013.01); *F01M 13/023* (2013.01); *F01M 2013/0038* (2013.01); *F01M 2013/0083* (2013.01)

(58) Field of Classification Search

CPC ..... F01M 13/0405; F01M 13/0011; F01M 13/022; F01M 2013/0038

See application file for complete search history.

(56) References Cited

U.S. PATENT DOCUMENTS

| | | | | |
|---|---|---|---|---|
| 3,200,838 | A | 8/1965 | Sheaffer | |
| 4,667,647 | A * | 5/1987 | Ohtaka | F01M 5/001 123/573 |
| 5,586,541 | A | 12/1996 | Tsai | |
| 6,899,091 | B2 * | 5/2005 | Akiyama | F01M 13/04 123/41.86 |
| 7,258,111 | B2 | 8/2007 | Shieh et al. | |
| 2014/0034031 | A1 | 2/2014 | Wagner | |
| 2014/0373953 | A1 | 12/2014 | Spanevello | |
| 2015/0276073 | A1 | 10/2015 | Cefai | |

FOREIGN PATENT DOCUMENTS

| | | |
|---|---|---|
| EP | 2336510 A1 | 6/2011 |
| EP | 2963258 A1 | 1/2016 |
| JP | 3762938 B2 | 4/2006 |

* cited by examiner

*Primary Examiner* — Kevin A Lathers

(74) *Attorney, Agent, or Firm* — Brooks Kushman P.C.; Julia Voutyras

(57) ABSTRACT

A positive crankcase ventilation valve for an engine is provided with a valve body defining apertures fluidly coupling a crankcase and an intake manifold of the engine, with each aperture sized to prevent an entrained oil droplet from flowing therethrough. The valve has a valve element supported by the body to selectively cover at least one of the apertures in response to a pressure difference between the manifold and the crankcase to provide variable air flow from the crankcase to the intake manifold. A method includes, in response to an increasing absolute pressure difference between the manifold and the crankcase, passively moving a valve element to selectively cover apertures fluidly coupling the crankcase and the manifold to control an air flow from the crankcase to the intake manifold to a predetermined variable flow profile, and separating oil droplets from the air flow via the apertures.

20 Claims, 4 Drawing Sheets

CRANKCASE VENTILATION VALVE FOR AN ENGINE

TECHNICAL FIELD

Various embodiments relate to a positive crankcase ventilation valve for an internal combustion engine.

BACKGROUND

During engine operation, small amounts of combustion gases, or blow-by gases, may leak past piston rings into the crankcase. Blow-by gases may contribute to engine emissions if left unmitigated, and therefore these blow-by gases may be directed from the crankcase to the intake manifold via a positive crankcase ventilation (PCV) system. The PCV systems are typically configured to draw air from the crankcase into the intake system, and subsequently the cylinders, thereby creating a closed loop for the blow-by gases and reducing emissions. These blow-by gases may entrain oil droplets and/or vapor when flowing through the crankcase. A conventional PCV system removes the oil droplets from the blow-by gases by passing the blow-by gases through a separate separator system prior to flowing through a PCV valve contained in the PCV system. This separator system increases the overall pressure drop across the PCV system as well as increases packaging space requirements and system costs. For example, with a separate upstream separator, a higher vacuum is needed in the intake system to draw the blow-by gases from the crankcase, which also limits the opportunities for operation of the PCV system.

SUMMARY

In an embodiment, an engine is provided with a crankcase, an intake manifold, and a valve fluidly coupling the crankcase and the intake manifold. The valve has a valve body and a valve member. The valve member moves in response to a pressure difference between the crankcase and manifold to selectively seal at least one of a series of apertures formed by one of the member and the body, each aperture sized to separate an entrained oil droplet.

In another embodiment, a positive crankcase ventilation valve for an engine is provided with a valve body defining apertures fluidly coupling a crankcase and an intake manifold, each aperture sized to prevent an entrained oil droplet from flowing therethrough. The valve has a valve element supported by the body to selectively cover at least one of the apertures in response to a pressure difference between the manifold and the crankcase to provide variable air flow from the crankcase to the intake manifold.

In yet another embodiment, a method of controlling airflow from a crankcase to an intake manifold is provided. In response to an increasing absolute pressure difference between the manifold and the crankcase, a valve element passively moves to selectively cover apertures fluidly coupling the crankcase and the manifold to control an air flow from the crankcase to the intake manifold to a predetermined variable flow profile. Entrained oil droplets are separated from the air flow via the apertures.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
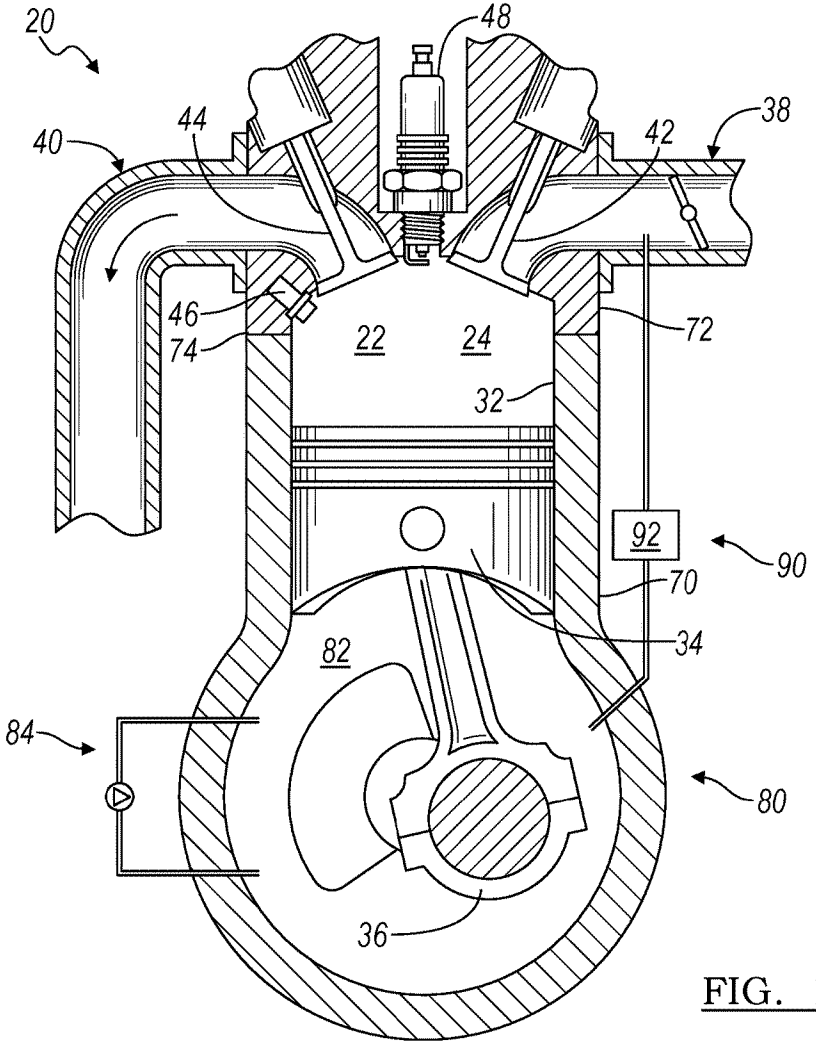
FIG. 1 illustrates a schematic of an engine according to an embodiment.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust system(s) 40 or exhaust manifold. The intake and exhaust valves 42, 44 may be operated in various ways as is known in the art to control the engine operation. The intake manifold 38 has an interior region that is defined by the various components of the intake manifold 38, for example, a plenum, runners to the intake valves, and the like.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust system 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust system 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust system 40 as described below and to an after-treatment system such as a catalytic converter.

The intake and exhaust valve 42, 44 positions and timing, as well as the fuel injection timing and ignition timing may be varied for the various engine strokes and other engine operating conditions.

The engine 20 has a cylinder block 70 and a cylinder head 72 that cooperate with one another to form the combustion chambers 24. A head gasket (not shown) may be positioned between the block 70 and the head 72 to seal the chamber 24. The cylinder block 70 has a block deck face that corresponds with and mates with a head deck face of the cylinder head 72 along part line 74.

The engine 20 also has a crankcase 80, and the crankcase may be partially formed by the cylinder block 70 as shown in FIG. 1. The crankcase 80 surrounds various journals and bearings to support the crankshaft 36 for rotation therein. The crankcase has a cover such as an oil pan or reservoir that seals or substantially seals the interior region 82 of the crankcase. A lubrication system 84 is fluidly connected to the crankcase 80 to provide lubricant thereto, for example, to lubricate the bearings for the crankshaft 36, as well as any other moving components of the engine 20.

The intake manifold 38 may selectively communicate with a positive crankcase ventilation (PCV) system 90, schematically illustrated in FIG. 1. The PCV system 90 may allow combusted gases that leak or migrate past the rings of piston into the crankcase 80 as blow-by gases to be vented into the intake manifold 38.

During combustion in the engine 20, blow-by gases may flow past the piston 34 and into the crankcase 80. It will be appreciated that the blow-by gases may include oil vapor, combustion gases, air, etc. The PCV system 90 is provided with the engine 20 to manage the blow-by gases. The system 90 has a valve 92 that also provides a separator function to remove oil droplets from the blow-by gases, or air flow, while simultaneously controlling the flow into the intake manifold 38. The PCV valve 92 is configured to adjust the amount of blow-by gases flowing therethrough, and the valve 92 may be passively operated as described herein based on system and engine pressures, or may be controlled using a controller according to other examples. The valve 92 operates to provide a variable flow rate of blow-by gases as a function of the pressure difference between the intake manifold and the crankcase or as a function of the intake manifold vacuum. For example, the intake manifold may be under a vacuum during engine operation, and the blow-by gases may be drawn from the crankcase via the PCV system 90 into the intake system 38 via the vacuum. As the intake manifold 38 may be under a vacuum, or at a low pressure, and the crankcase 80 may have a higher pressure, the pressure difference discussed herein may be an absolute pressure difference for clarity. For example, during an engine idle condition, the absolute pressure difference between the intake manifold 38 and the crankcase 80 may be low or substantially zero as the air flow into the cylinders is low and the amount of blow-by gases may also be low. The pressure difference increases as the engine load increases and the throttle is opened, as the vacuum in the intake manifold will increase and the amount of blow-by gases may also increase. Note that an increase in manifold vacuum corresponds with a decrease in manifold pressure.

Figure 2:
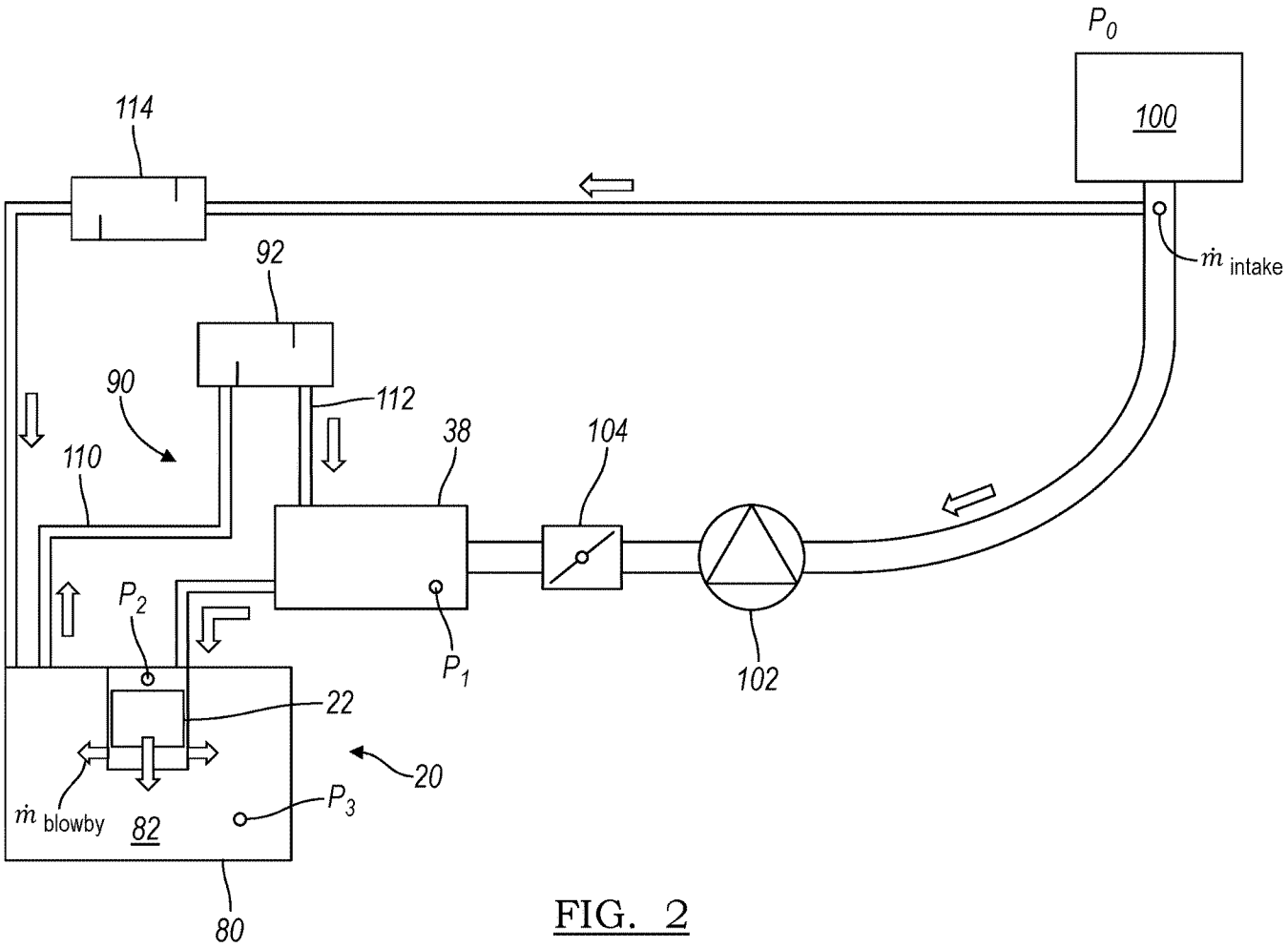
FIG. 2 illustrates a schematic of a PCV system including the engine of FIG. 1 according to an embodiment.

FIG. 2 illustrates a schematic of an engine 20 and associated intake and crankcase ventilation systems according to an example, and may use the engine 20 as described above with respect to FIG. 1.

Intake air enters the intake 38 at inlet 100, which may include an air filter. Air at the inlet 100 is at an ambient or environmental pressure (P0). In some examples, the engine 20 may be provided with forced induction device 102 such as a turbocharger or a supercharger to increase the pressure of the intake air, and thereby increase the mean effective pressure to increase the engine power output. In other examples, the engine 20 may be naturally aspirated. The forced induction device 102 may be any suitable turbomachinery device including one or more turbochargers, a supercharger, and the like. The forced induction device may additionally have an intercooler or other heat exchanger to reduce the temperature of the intake air after the compression process.

The intake air flow is controlled by a throttle valve 104. The throttle valve 104 may be electronically controlled using an engine control unit, mechanically controlled, or otherwise activated or controlled. The intake air flows through an intake manifold 38 and is drawn into the cylinders 22 of the engine 20 where it is mixed and reacted with fuel to rotate the crankshaft and provide power from the engine 20. The intake manifold operates with an intake pressure (P1), also known as an intake vacuum. The exhaust system from the engine 20 is not illustrated in FIG. 2.

The pressure (P2) in the cylinder 22 varies based on the positions of the intake and exhaust valves, and the operating state of the engine. For example, during the intake stroke, the pressure in the cylinder 22 is a vacuum as the piston moves downward to drawn air into the cylinder. After the combustion event, the pressure P2 in the cylinder 22 rises to a high positive pressure value, which drives the expansion stroke.

The high cylinder pressures (P2) may result in blow-by gases flowing past the piston and into the crankcase 80. As more blow-by gases flow into the crankcase 80, the pressure in the crankcase (P3) may increase, and the gases in the crankcase 80 may need to be vented.

A crankcase ventilation system 90 uses a valve 92, or PCV valve 92, to control the flow of blow-by gases from the crankcase 80 to the intake manifold 38. The valve 92 has an intake side 110 that is fluidly coupled with the crankcase 80 and is at or substantially at the crankcase pressure (P3). The valve 92 also has an outlet side 112 that is fluidly coupled to the intake manifold 38 and is at or substantially at the intake manifold pressure (P1) or intake manifold vacuum.

The crankcase ventilation system 90 may also include another valve 114 that fluidly connects the crankcase 80 to the air inlet 100. Valve 114 may be operated to draw outside air into the crankcase 80 to provide an additional air flow into the crankcase to help in sweeping the blow-by gases out of the crankcase 80 and into the intake manifold 38. Valve 114 may also be known as a breather valve.

Figure 4:
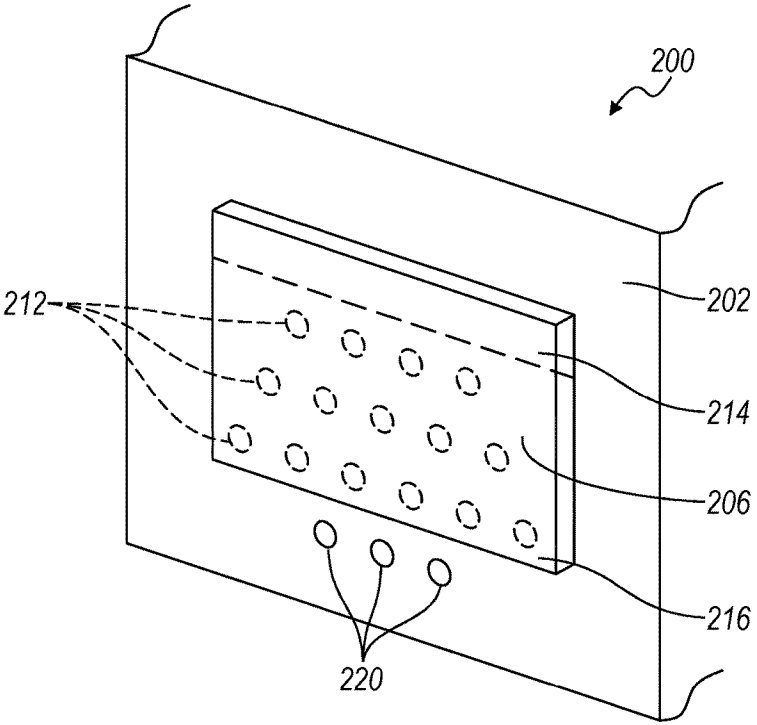
FIG. 4 illustrates the valve of FIG. 3 in a second position.
Figure 3:
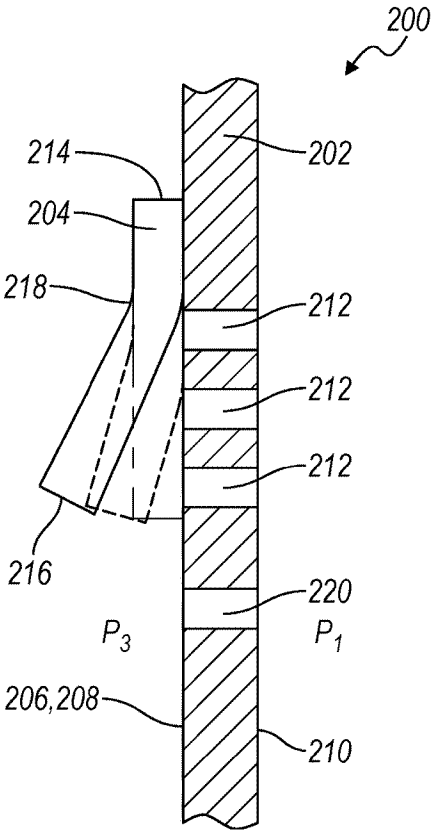
FIG. 3 illustrates a positive crankcase ventilation valve according to an embodiment in a first position.

FIG. 3 illustrates a cross-sectional view of a valve 200 according to an embodiment. FIG. 4 illustrates a perspective view of the valve 200. The valve 200 may be used as the PCV valve 92 as described above with respect to FIGS. 1-2.

The valve 200 fluidly couples the crankcase 80 and the intake manifold 38. The valve 200 has a valve body 202 and a valve member 204. In one example, the engine 20 has wall 206 that forms a portion of the crankcase 80. The wall 206 has a first side 208 and a second opposed side 210. The first side 208 of the wall may form a portion of the interior of the crankcase 80. The pressure of gases on the first side 208 of the wall are at the crankcase pressure P3. The second side 210 of the wall may form a portion of the interior of the intake manifold 38. The pressure of gases on the second side 210 of the wall are at the intake manifold pressure P1. In other examples, the first side 208 of the wall may be connected via a conduit to the crankcase 80, and/or the second side 210 of the wall may be connected via a conduit to the intake manifold 38. The wall 206 may support the valve body 202, or alternatively, a region of the wall 206 may itself define and provide the valve body 202.

The valve body 202 defines a series of apertures 212 therethrough. The apertures 212 are spaced apart from one another and may be arranged as an array, for example, in one or more rows and one or more columns, or alternatively, may be arranged in another pattern through the wall 206. The apertures 212 may be equally spaced from one another or may have variable spacing between different apertures. The rows and/or columns may have an equal number of apertures 212 or may have greater or fewer apertures compared to an adjacent row or column.

The apertures 212 may be defined by a circular shape, or alternatively may have other geometrical or complex shapes. The apertures 212 may have a constant cross-sectional area across the wall 206 or may increase or decrease in cross-sectional area, for example, as a taper. The apertures 212 may extend across the wall 206 and oriented in a perpendicular manner to the wall 206, or may be oriented such that the apertures are oriented at an acute angle relative to the wall 206 or are inclined relative to the wall. For example, the apertures 212 may be oriented with the entrance to the aperture 212 on side 208 of the wall at a lower relative height than the exit of the aperture 212 on the other side 210 of the wall 206. An inclined aperture 212 may assist in the oil separation and drainback function to the crankcase 80 provided by the valve 200 such that oil droplets separated from air flow by an aperture 212 falls back into the crankcase 80.

The valve member or valve element 204 is supported by the valve body 202 (or the wall 206). The valve member 204 moves relative to the valve body 202 to selectively cover at least a portion of the series of apertures 212. In one example, the valve 200 provides for variable flow through the valve based on a position of the valve member 204. For example, the valve member 204 may cover all of the apertures 212, none of the apertures 212, or a portion of the aperture 212. The portion of apertures 212 covered by the valve member 204 may vary based on the valve position to provide further control of the flow through the valve. The valve position may be a function of intake manifold vacuum or a pressure difference across the valve.

The valve member 204 may be a reed valve flap as shown. The valve member 204 is connected along an end region 214 to the valve body 202, for example, using one or more mechanical fasteners, an adhesive, or a process such as welding. The opposed end region 216 is not connected to the valve body 202 such that it is moveable relative to the valve body 202. The valve member 204 may be made of one or more layers of material, and in some embodiments, includes a metal or a metal alloy. The valve member 204 may alternatively be made from a plastic, nylon, or other material. The valve member 204 may include a sealing layer on the side of the valve member 204 facing the wall 206 to assist in sealing when pressed against the wall 206.

The valve member 204 has a biasing region 218 that biases the valve member 204 away from the valve body, such that the valve 200 is a normally open valve. Multiple biasing regions 218 may extend across the valve, to allow for rows of apertures 212 to be selectively covered based on the pressure difference between the crankcase and the intake manifold, or based on the amount of vacuum in the intake manifold. The valve member 204 is illustrated in a first, open position in FIG. 3. The valve member 204 is also illustrated in a second, closed position in FIG. 3 in broken lines, and in a third, intermediate position in FIG. 3 in dotted lines. Additional intermediate positions are available for the valve member 204 between the first and third position, and between the third and second position such that the valve member 204 position is continuously variable. FIG. 4 illustrates the valve 200 in the second closed position.

As the absolute pressure difference, $|(P3-P1)|$, increases, or as the vacuum in the intake manifold increases (or P1 decreases), the valve member 204 begins to move from the first position towards the second position. The position of the valve member 204, and therefore the flow through the valve 200, is a function of this pressure difference, or is a function of the intake manifold vacuum.

The valve member 204 moves in response to the pressure difference between the crankcase 80 and manifold 38 to selectively seal one or more of the apertures 212 as a function of the pressure difference to provide variable flow through the valve 200.

The valve 200 also has one or more fixed orifices or apertures 220 defined by the valve body 202 and wall 206 to fluidly couple the crankcase 80 with the intake manifold 38. The fixed orifices 220 are spaced apart from the valve member 204 such that the orifices 220 remain open for flow therethrough regardless of the position of the valve member 204, such that flow through the orifices 220 is independent of the valve member 204 position. This allows for a fixed low flow of crankcase blow-by gases to flow into the intake manifold 38 and vent from the crankcase 80 even with the valve member 204 in the fully closed position. The orifices 220 may be the same or different as the apertures 212 as described above, and may be formed in various manners as described above with respect to the apertures 212.

Each of the apertures 212 and orifices 220 are sized to provide an oil separator for the PCV system. Each aperture 212 and each orifice 220 may be same size or may be different in size. In one example, each of the apertures 212 and orifices 220 are less than 5 millimeters (mm), less than 1 mm, or as small as 0.1 mm in diameter. The apertures 212 and orifices 220 are sized to prevent an oil droplet or lubricant droplet entrained in the air flow from passing or flowing therethrough, such that the apertures and orifices act as a separator for the entrained oil droplets between the crankcase 80 and the intake manifold 38. An oil droplet may be defined as an average sized liquid droplet of lubricant in the engine system, and may have an average diameter larger than a corresponding diameter of the orifice. The average droplet size and the orifice size may be at least partially based on the engine size and expected operating conditions. In one example, the engine is a larger block design with crankcase gas flows up to 200 liters per minute, and a corresponding orifice size on the order of 3-5 millimeters. In another example, the engine is a smaller block design with crankcase gas flows up to 30 liters per minute, and a corresponding orifice size of 0.1 to 1 millimeters. The system therefore operates without an additional separator positioned upstream of the valve 200. The valve 200 may allow vaporized lubricant to flow across the valve and into the intake manifold 38, and may provide for the flow of entrained oil droplets of small sizes, e.g. on the order of microns, to pass through. The apertures 212 and orifices 220 may be provided with a coating, for example, to provide a contact angle of less than ninety degrees for the valve 200 surfaces such that the droplets bead and fall from the valve 200 and into the crankcase 38.

Figure 7:
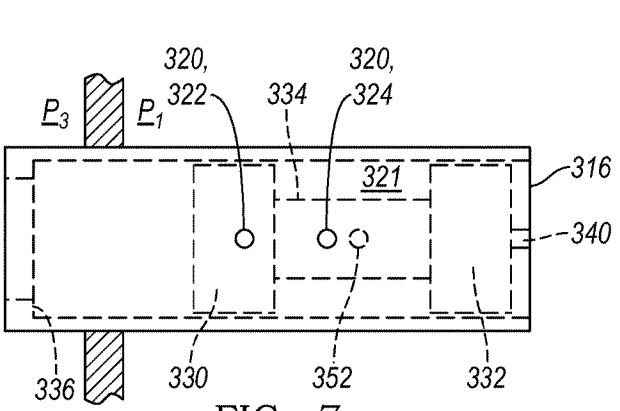
FIG. 7 illustrates the valve of FIG. 5 in a third position.
Figure 5:
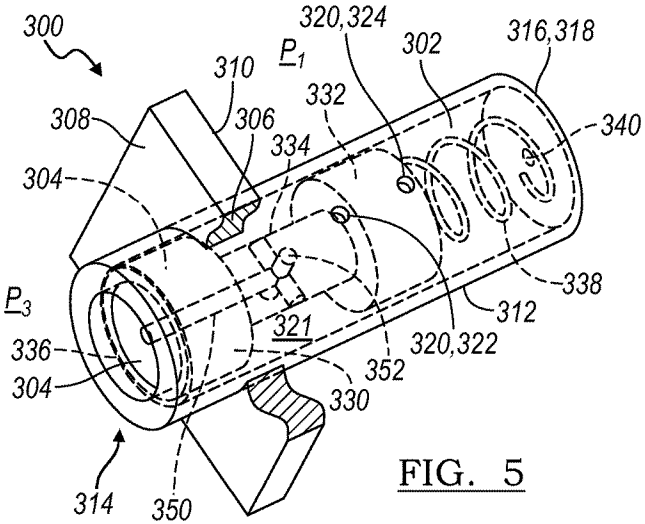
FIG. 5 illustrates a positive crankcase ventilation valve according to another embodiment in a first position.
Figure 6:
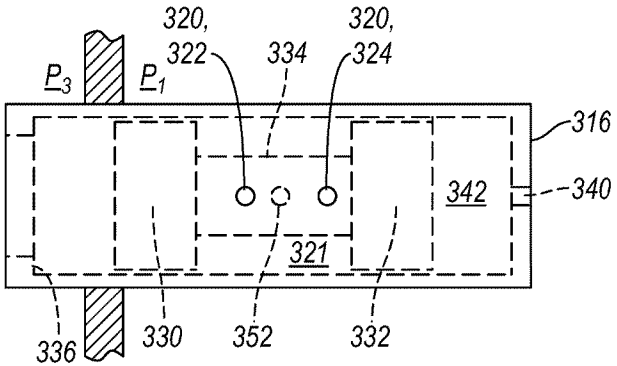
FIG. 6 illustrates the valve of FIG. 5 in a second position.

FIGS. 5-7 illustrate a valve 300 according to another embodiment. The valve 300 may be used as the PCV valve 92 as described above with respect to FIGS. 1-2. The valve 300 fluidly couples the crankcase and the intake manifold. The valve 300 has a valve body 302 and a valve member 304. In one example, the engine 20 has wall 306 that forms a portion of the crankcase. The wall 306 has a first side 308 and a second opposed side 310. The first side 308 of the wall may form a portion of the interior of the crankcase 80. The pressure of gases on the first side of the wall are at the crankcase pressure P3. The second side 310 of the wall may form a portion of the interior of the intake manifold 38. The pressure of gases on the second side of the wall are at the intake manifold pressure P1. In other examples, the first side 308 of the wall may be connected via a conduit to the crankcase, and/or the second side 310 of the wall may be connected via a conduit to the intake manifold. The wall 306 may support the valve body 302.

The valve body 302 may be provided with a side wall forming a tube 312 that extends through and across the wall. The tube 312 has a first end 314 and a second opposed end 316. The first end 314 of the body 302 defines an aperture or is open to the crankcase side of the valve 300 on the first side of the wall. The second end 316 of the tube is a closed end, for example, via an end wall 318, and is positioned on the second side of the wall. The side wall and the end wall 318 of the valve body 302 define an interior volume 321 of the valve body.

The side wall of the tube defines a series of apertures 320. The apertures 320 may be arranged longitudinally on the side wall such that the apertures 320 are spaced apart longitudinally on the side wall of the valve body. Alternatively, the apertures 320 may be arranged in groups of apertures at various longitudinal positions on the side wall, with varying numbers of apertures in each group. In the present example, the valve body defines a first group of apertures 322, containing at least a first aperture, and a second group of apertures 324 containing at least a second aperture. The first and second groups of apertures 322, 324 are longitudinally spaced from each other on the valve body 302. In other examples, additional groups of apertures may be provided. The groups 322, 324 of apertures 320 may be equally spaced from one another or may have variable spacing between different groups and/or apertures. Each group 322, 324 of apertures 320 may have an equal number of apertures or may have greater or fewer apertures than an adjacent group.

The apertures 320 fluidly connect the interior 321 of the valve body with the intake manifold side 310 of the valve 300. Therefore, the apertures 320 are positioned on the second side 310 of the wall 306.

A valve member 304 is positioned within the valve body 302. The valve member 304 translates or slides within the valve body 302. In the present example, the valve member 304 may be referred to as a slider 304. The slider 304 has a first end region 330 and a second opposed end region 332. Each end region is sized to fit within and cooperate with the side wall of the valve body. At least the first end region 330 forms a seal with the side wall 312 of the valve body such that gases may not flow between the first end region 330 and the side wall 312. An O-ring, gasket, or other sealing member may be provided between the first end region and the side wall. The second end region 332 may also form a seal with the side wall 312.

The first and second end regions 330, 332 of the valve member are connected by a neck 334 or other intermediate member. The neck 334 is sized to have a smaller diameter than the first and second end regions 330, 332 such that the outer surface of the neck is spaced apart from the side wall 312 of the valve body.

A retaining feature 336, as illustrated in FIG. 6, may be provided around the open end 314 of the valve body after the slider 304 is positioned within the valve body to retain the slider within the interior region of the valve body. A biasing member 338, such as a spring as shown in FIG. 5, may be positioned between the second end region 332 and the end wall 318 of the valve body to bias the valve member 304 towards the open end 314 of the valve body and away from the end wall. In other examples, an orifice 340 may be additionally or alternatively provided on the end wall of the valve body such that a pressure chamber 342 is formed within the interior region of the valve body and is defined by the end wall, the side wall, and the end face of the second end region of the slider as shown in FIG. 6. This pressure chamber may additionally control a position of the valve member 304.

The slider 304 defines a longitudinal hole 350 extending from an end face of the slider at the first end region 330 into the neck 334. In some examples, the longitudinal hole 350 is provided as a blind bore into the slider with the end of the bore in the neck region or in the second end region. The slider also defines at least one transverse hole 352 extending from the longitudinal hole 350 outwardly to intersect the neck. In the present example, the slider 304 has a series of transverse holes 352 fluidly connecting the longitudinal hole with the interior region of the valve body adjacent to the neck. The transverse holes 352 may be positioned at a common longitudinal position along the slider, or may be longitudinally spaced apart or otherwise arranged on the neck.

The slider 304 moves between a first position as shown in FIG. 5 and a second position as shown in FIG. 7. The slider is translatable between these two positions to provide intermediate positions between the first and second positions. FIG. 6 illustrates a third, intermediate position for the slider.

In FIG. 5, the slider 304 is in the first position such that the second end region 332 of the slider is spaced apart from the second end 316 of the tube. The transverse holes 352 of the slider are in fluid communication with the first aperture 322 of the valve body such that gases in the crankcase flow through the longitudinal hole 350, the transverse hole 352, and the first group of apertures 322 and into the intake manifold 38. The second group of apertures 324 is blocked by the second end region 332 of the slider such that no gases from the crankcase flow through the second group of apertures 324 and into the intake manifold.

In FIG. 7, the slider 304 is in the second position such that the second end region 332 of the slider is adjacent to the second end 316 of the tube. The transverse holes 352 of the slider are in fluid communication with the second aperture 324 of the valve body such that gases in the crankcase flow through the longitudinal hole 350, the transverse hole 352, and the second group of apertures 324 and into the intake manifold. The first group of apertures 322 is blocked by the first end region 330 of the slider such that no gases from the crankcase flow through the first group of apertures and into the intake manifold.

In FIG. 6, the slider 304 is in the third position, or an intermediate position between the first and second positions. The transverse holes 352 of the slider are in fluid communication with the first and second aperture 322, 324 of the valve body such that gases in the crankcase flow through the longitudinal hole 350, the transverse hole 352, and the first and second groups of apertures 322, 324 and into the intake manifold. No apertures 320 of the valve body 302 are blocked by the valve member 304 in FIG. 6.

The apertures 320 in the valve body, and the apertures 350, 352 in the valve member may be provided with a circular shape, or alternatively may have other geometrical or complex shapes. The apertures may have a constant cross-sectional area or may increase or decrease in cross-sectional area, for example, as a taper.

The slider 304 translates or moves from the first position towards the second position in response to an increasing absolute pressure difference, $|(P3-P1)|$, between the intake manifold 38 and the crankcase 80, or as the vacuum in the intake manifold increases. The position of the valve member 304, and therefore the flow through the valve 300, is a function of this absolute pressure difference, or is a function of the intake manifold vacuum.

The valve member 304 moves relative to the valve body 302 to selectively cover and uncover at least a portion of the apertures 320 in the valve body. In one example, the valve 300 provides for variable flow through the valve based on a position of the valve member 304. The portion of apertures 320 covered or uncovered by the valve member 304 may vary based on the valve position to provide further control of the flow through the valve.

The valve member 304 moves in response to the pressure difference between the crankcase and manifold to selectively seal or block one or more of the apertures 320 as a function of the pressure difference to provide variable flow through the valve 300.

Note that in all positions of the valve 300, some flow is provided across the valve to fluidly couple the crankcase 80 with the intake manifold 38. This allows for a fixed low flow of crankcase blow-by gases to flow into the intake manifold and vent from the crankcase regardless of valve position.

Each of the apertures 320, 352 in the valve body and valve member are sized to provide an oil separator for the PCV system. Each aperture may be same size or may be different in size. In one example, each of the apertures 320, 352 are less than 5 millimeters (mm), less than 1 mm, or less than 0.1 mm in diameter. Note that the longitudinal aperture 350 may be larger in diameter than the transverse apertures 352 and valve body apertures 320 to provide sufficient air flow through the valve 300. At least the apertures 320 are sized to prevent an entrained oil droplet or lubricant droplet as described above from passing or flowing therethrough, such that the apertures 320 act as a separator between the crankcase 80 and the intake manifold 38. At least the apertures 320 may also be sized based on an expected or maximum crankcase gas flow rate as described above. The system therefore operates without an additional separator positioned upstream of the valve 300. The valve 300 may allow vaporized lubricant to flow across the valve 300 and into the intake manifold 38, and may provide for the flow of entrained oil droplets of small sizes, e.g. on the order of microns, to pass through. The various surfaces within the valve 300 that cause the air flow to turn or bend may additionally provide for separation of oil droplets of sizes less than the orifice diameters based on separation via impaction or centrifugal forces. The apertures 320, 350, 352 and other valve surfaces 300 may be provided with a coating, for example, to provide a contact angle of less than ninety degrees for the valve 300 surfaces such that the droplets bead and fall from the valve 300 and into the crankcase 38. The valve 300 may additionally define a drain channel (not shown) extending from and fluidly connecting a low point in the interior region 321 between the first and second end regions of the valve member and the crankcase 80.

Figure 8:
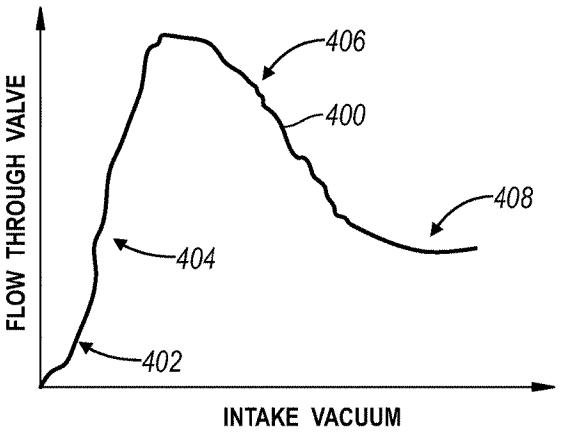
FIG. 8 illustrates flow rate with absolute pressure difference for the valves of FIGS. 3 and 5.

FIG. 8 is a graph illustrating a profile 400 of air flow through the valve 200 or valve 300 as intake vacuum increases, the pressure in the intake manifold (P1) decreases or the pressure difference $|(P3-P1)|$ increases. Initially, at a low intake manifold vacuum level in region 402 associated with an engine idle operating condition, the valve 200, 300 provides for flow across the valve, for example via orifices and apertures in valve 200 or the first group of apertures in valve 300.

As the intake manifold vacuum level increases, for example, with increasing engine load, flow across the valve also increases as shown in region 404. In valve 200, the apertures 212 are generally uncovered by the valve member, and the increasing flow rate is based on a higher pressure differential across the valve. In valve 300, the valve body 304 may begin to move such that the first and second groups of apertures 322, 324 are uncovered.

In region 406, the intake manifold vacuum has increased to the point that the flow across the valve begins to reduce. The valve member in valve 200 is moved to cover at least a portion of the apertures 212. In valve 300, the valve member is moving such that the first group of apertures 322 is covered by the valve member 304.

With further increases in intake manifold vacuum, for example in region 408, the flow across the valve is limited or restricted and approaches a fixed value. In valve 200, the valve member is covering the apertures 212, the flow across the valve is only via the orifices 220. In valve 300, the first group of apertures 322 is covered, and flow across the valve is only via the second group of apertures 324.

The airflow from a crankcase 80 to an intake manifold 38 may therefore be controlled via the valve 200, 300 to a variable flow rate based on the intake manifold vacuum, or the pressure difference between the intake manifold and the crankcase. In response to an increasing absolute pressure difference between the manifold and the crankcase, the valve element 204, 304 is passively to selectively cover apertures fluidly coupling the crankcase and the manifold to control an air flow from the crankcase to the intake manifold to a predetermined variable flow profile, such as the profile 400 shown in FIG. 8. Oil droplets are separated from the air flow via the apertures in the valve 200, 300. Air flow is also provided from the crankcase to the manifold via at least one of the apertures independently of a position of the valve element 204, 304.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments.

What is claimed is:

1. An engine comprising:

a crankcase;

an intake manifold; and a valve fluidly coupling the crankcase and the intake manifold and having a valve body and a valve member, the valve member moving in response to a pressure difference between the crankcase and manifold to selectively seal at least one of a series of apertures formed by one of the member and the body, each aperture sized to separate an entrained oil droplet.

2. The engine of claim 1 wherein each aperture in the series of apertures is sized to be less than five millimeters in diameter.

3. The engine of claim 1 wherein each aperture in the series of apertures is sized to be less than one millimeters in diameter.

4. The engine of claim 1 further comprising a wall having a first side forming a portion of the crankcase interior and a second side forming a portion of the intake manifold interior;

wherein the wall supports the valve body for the valve; and wherein the valve body defines the series of apertures.

5. The engine of claim 4 wherein the wall defines the series of apertures such that the wall comprises the valve body.

6. The engine of claim 4 wherein the valve member comprises a reed valve flap connected to the first side of the wall.

7. The engine of claim 6 wherein the reed valve flap is spaced apart from the series of apertures in a first position, and covers the series of apertures in a second position.

8. The engine of claim 7 wherein the reed valve flap is in the first position based on a first absolute pressure difference between the intake manifold and the crankcase; and wherein the reed valve flap is in the second position based on a second absolute pressure difference between the intake manifold and the crankcase, the second absolute pressure difference being greater than the first absolute pressure difference.

9. The engine of claim 8 wherein the reed valve covers a portion of the series of apertures based on a third absolute pressure difference between the intake manifold and the crankcase, the third absolute pressure difference being greater than the first absolute pressure difference and less than the second absolute pressure difference.

10. The engine of claim 4 wherein the valve body further defines an orifice fluidly coupling the crankcase and the intake manifold independent of a position of the valve member.

11. The engine of claim 1 wherein the valve body is formed by a tube extending through the wall and having a first open end on the first side of the wall and a second closed end on the second side of the wall, the tube defining the series of apertures; and wherein the valve member is formed by a slider positioned within the tube.

12. The engine of claim 11 wherein the slider has first and second end regions connected by a neck, the slider defining a longitudinal hole extending from the first end region into the neck, and defining at least one transverse hole extending from the next to the longitudinal hole; the first and second end regions forming a seal with the tube, the second end region positioned between the first end region and the second end of the tube.

13. The engine of claim 12 wherein the series of apertures are spaced apart longitudinally on the tube as a first aperture and a second aperture.

14. The engine of claim 13 wherein the second end region of the slider is spaced apart from the second end of the tube in a first position such that the transverse hole is in fluid communication with the first aperture, and the second aperture is blocked by the second end region of the slider;

wherein the second end region of the slider is adjacent to the second end of the tube in a second position such that the transverse hole is in fluid communication with the second aperture, and the first aperture is blocked by the first end region of the slider; and wherein the slider has a third position between the first and second positions such that the transverse hole is in fluid communication with the first and second apertures.

15. The engine of claim 14 wherein the slider slides from the first position towards the second position in response to an increasing absolute pressure difference between the intake manifold and the crankcase.

16. The engine of claim 1 wherein the apertures in the valve provide for separation of droplets from an air flow such that the engine is independent of a separator positioned upstream of the valve.

17. A positive crankcase ventilation valve for an engine comprising:

a valve body defining apertures fluidly coupling a crankcase and an intake manifold, each aperture sized to prevent an entrained oil droplet from flowing therethrough; and a valve element supported by the body and selectively covering at least one of the apertures in response to a pressure difference between the manifold and the crankcase to provide variable air flow from the crankcase to the intake manifold.

18. The valve of claim 17 wherein each aperture is less than 5 millimeters in diameter.

19. A method of controlling airflow from a crankcase to an intake manifold comprising:

in response to an increasing absolute pressure difference between the manifold and the crankcase, passively moving a valve element to selectively cover apertures fluidly coupling the crankcase and the manifold to control an air flow from the crankcase to the intake manifold to a predetermined variable flow profile; and separating entrained oil droplets from the air flow via the apertures.

20. The method of claim 19 further comprising providing air flow from the crankcase to the manifold via at least one of the apertures independently of a position of the valve element.

* * * * *